US006537443B1

(12) United States Patent
Frankiewicz et al.

(10) Patent No.: US 6,537,443 B1
(45) Date of Patent: Mar. 25, 2003

(54) PROCESS FOR REMOVING MERCURY FROM LIQUID HYDROCARBONS

(75) Inventors: Theodore C. Frankiewicz, Sugar Land, TX (US); John Gerlach, Las Vegas, NV (US)

(73) Assignee: Union Oil Company of California, El Segundo, CA (US)

( * ) Notice: Subject to any disclaimer, the term of this patent is extended or adjusted under 35 U.S.C. 154(b) by 0 days.

(21) Appl. No.: 09/512,555

(22) Filed: Feb. 24, 2000

(51) Int. Cl.[7] ..... C10G 29/00; C10G 29/02; C10G 29/28

(52) U.S. Cl. ..... 208/251 R; 208/293; 208/299; 208/301; 208/302; 208/307

(58) Field of Search ..... 208/251 R, 293, 208/299, 301, 302, 307

(56) References Cited

U.S. PATENT DOCUMENTS

| | | | | | |
|---|---|---|---|---|---|
| 4,474,896 | A | | 10/1984 | Chao | 502/216 |
| 4,839,029 | A | | 6/1989 | Ichikawa et al. | 208/251 R |
| 4,877,515 | A | | 10/1989 | Audeh | 208/251 R |
| 4,880,527 | A | | 11/1989 | Audeh | 208/251 R |
| 4,915,818 | A | | 4/1990 | Yan | 208/251 |
| 4,946,596 | A | | 8/1990 | Furuta et al. | 210/679 |
| 4,950,408 | A | * | 8/1990 | Duisters et al. | 208/106 |
| 4,985,389 | A | * | 1/1991 | Audeh | 208/251 R |
| 4,986,898 | A | | 1/1991 | Torihata et al. | 208/251 |
| 5,037,552 | A | | 8/1991 | Furuta et al. | 210/634 |
| 5,245,106 | A | | 9/1993 | Cameron et al. | 585/823 |
| 5,338,444 | A | | 8/1994 | van Buren et al. | 210/660 |
| 5,463,167 | A | | 10/1995 | Ou | 585/823 |
| 5,523,067 | A | | 6/1996 | Markovs | 423/99 |
| 5,736,053 | A | | 4/1998 | Ikushima et al. | 210/688 |
| 6,258,334 | B1 | | 7/2001 | Gadkaree et al. | 423/210 |
| 6,268,543 | B1 | | 7/2001 | Sakai et al. | 585/836 |
| 6,350,372 | B1 | | 2/2002 | Degnan et al. | 208/251 R |

FOREIGN PATENT DOCUMENTS

| | | | |
|---|---|---|---|
| EP | 0342898 | | 11/1989 |
| EP | 0352420 | | 1/1990 |
| EP | 0385742 | | 9/1990 |
| EP | 0433677 | | 6/1991 |
| EP | 0480603 | | 4/1992 |
| EP | 0755994 | | 1/1997 |
| JP | 3-250092 A | * | 11/1991 |
| JP | 4-214794 A | * | 8/1992 |
| JP | 9-40971 A | * | 2/1997 |
| WO | WO9115559 | | 10/1991 |

* cited by examiner

*Primary Examiner*—Walter D. Griffin
(74) *Attorney, Agent, or Firm*—Yale S. Finkle; Gregory F. Wirzbicki

(57) ABSTRACT

Mercury is removed from crude oils, natural gas condensates and other liquid hydrocarbons by first removing colloidal mercury and solids that contain adsorbed mercury and then treating the hydrocarbons with an organic or inorganic compound containing at least one sulfur atom reactive with mercury. The sulfur compound reacts with dissolved mercury that contaminates the hydrocarbons to form mercury-containing particulates that are then removed from the hydrocarbons to produce a purified product having a reduced mercury content. Preferably, the treating agent is an organic sulfur-containing compound such as a dithiocarbamate or sulfurized isobutylene.

34 Claims, 1 Drawing Sheet

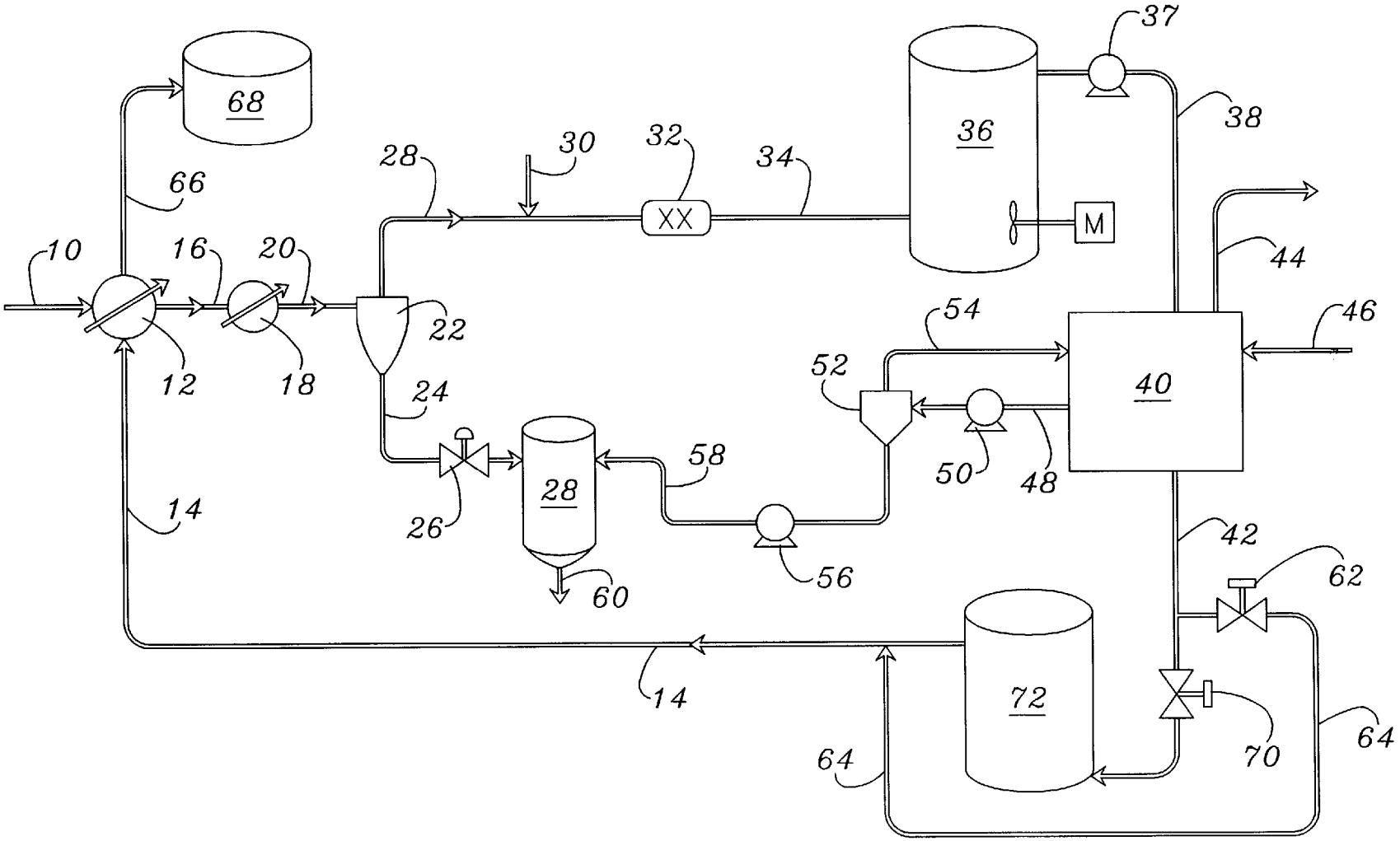
10
12
14
16
18
20
22
24
26
28
30
32
34
36
37
38
40
42
44
46
48
50
52
54
56
58
60
62
64
66
68
70
72
M
XX

PROCESS FOR REMOVING MERCURY FROM LIQUID HYDROCARBONS

BACKGROUND OF INVENTION

This invention relates generally to methods of removing mercury from liquid hydrocarbons and is particularly concerned with methods for removing mercury from crude oil and natural gas condensates using sulfur-containing organic and/or inorganic compounds.

Natural gas and crude oils produced in certain geographic areas of the world contain mercury in sufficient quantities to make them undesirable as refinery or petrochemical plant feedstocks. For example, hydrocarbon condensates derived from natural gas produced in regions of Indonesia and Thailand often contain over 1000 parts per billion by weight (ppbw) of mercury, while crude oils from the Austral Basin region of Argentina frequently contain well over 2000 ppbw mercury. If these condensates and crudes are distilled without first removing the mercury, it will pass into distillate hydrocarbon streams, such as naphtha and gas oils, derived from these feeds and poison hydrotreating and other catalysts used to further refine these distillate streams.

In the past, adsorbents, gas stripping and chemical precipitation methods have been used to remove mercury from crudes and other hydrocarbon liquids prior to their processing in order to avoid catalyst poisoning problems. The use of fixed bed adsorbents, such as 30 activated carbon, molecular sieves, metal oxide-based adsorbents and activated alumina, to remove the mercury is a potentially simple approach but has several disadvantages. For example, solids in the crude oil tend to plug the adsorbent bed, and the cost of the adsorbent may be excessive when mercury levels are greater than 100 to 300 ppbw. Also, large quantities of spent adsorbent are produced when treating hydrocarbon liquids having high levels of mercury, thereby making it imperative to process the spent adsorbent to remove adsorbed mercury before either recycle or disposal of the adsorbent.

Gas stripping, although simple, also has drawbacks. To be effective the stripping must be conducted at high temperature with relatively large amounts of stripping gas. Since crudes contain a substantial amount of light hydrocarbons that are stripped with the mercury, these hydrocarbons must be condensed and recovered to avoid substantial product loss. Moreover, the stripping gas must either be disposed of or recycled, both of which options require the stripped mercury to be removed from the stripping gas.

Chemical precipitation includes the use of hydrogen sulfide or sodium sulfide to convert mercury in the liquid hydrocarbons into solid mercury sulfide, which is then separated from the hydrocarbon liquids. As taught in the prior art, this method requires large volumes of aqueous sodium sulfide solutions to be mixed with the liquid hydrocarbons. The drawbacks of this requirement include the necessity to maintain large volumes of two liquid phases in an agitated state to promote contact between the aqueous sodium sulfide solution and the hydrocarbon liquids, which in turn can lead to the formation of an oil-water emulsion that is difficult to separate.

It is obvious from the above discussion that there exists a need for more effective processes to efficiently remove relatively large quantities of mercury from crude oils and other liquid hydrocarbons without the disadvantages of conventional techniques.

SUMMARY OF THE INVENTION

In accordance with the invention, it has now been found that certain sulfur-containing organic and/or inorganic compounds can be used, either directly or supported on carrier solids, to efficiently and effectively remove mercury from crude oils and other liquid hydrocarbons. In one embodiment of the process of the invention, particulate solids, such as diatomite (diatomaceous earth) and zeolites among others, on which is supported either (1) an alkali or alkaline earth metal sulfide or polysulfide, (2) an alkali metal trithiocar-bonate, or (3) an organic compound containing at least one sulfur atom reactive with mercury, are mixed or agitated with the mercury-containing hydrocarbon liquids. The solids and any particulates formed during the mixing are then separated from the mixture to produce hydrocarbons of reduced mercury content.

In another embodiment of the invention, the mercury-containing liquid hydrocarbons are directly mixed or agitated with an organic compound containing at least one sulfur atom reactive with mercury, such as a dithiocarbamate, under conditions that the organic compound reacts with mercury in the hydrocarbon feed to produce mercury-containing particulates. These particulates are then removed from the mixture to produce mercury-depleted hydrocarbon liquids.

In yet another embodiment of the invention, the contaminated hydrocarbon feed is mixed with sufficient amounts of (1) an aqueous solution of an alkali metal or alkaline earth metal sulfide or polysulfide, or (2) an alkali metal trithiocarbonate such that the resultant mixture contains a volume ratio of the aqueous solution to the liquid hydrocarbon feed less than 0.003. The mercury-containing particulates formed during mixing are then separated from the mixture to produce hydrocarbons of reduced mercury concentration. Since only small volumes of aqueous solutions are utilized, it is easier to maintain the aqueous and hydrocarbon phases in intimate contact without forming detrimental emulsions and contaminating the hydrocarbons with excess sulfur.

Quite frequently the liquid hydrocarbons to be treated in the process of the invention will contain particulate matter on which a portion, sometimes over 50 weight percent, of the mercury that contaminates the liquids is adsorbed. In such cases it is normally necessary to remove the mercury-contaminated particles, usually by filtration or the use of a hydrocyclone, from the hydrocarbons before treating the remaining liquids to remove dissolved mercury.

In a preferred embodiment of the invention, a crude oil or natural gas condensate containing dissolved mercury, colloidal mercury and mercury-contaminated particulate matter is first treated to remove particulates and colloidal mercury and then mixed with a monomeric or polymeric alkyl dithiocarbamate, which reacts with the dissolved mercury to form mercury-containing particulate solids. These resultant solids are then separated from the mixture to produce a crude oil or natural gas condensate having a reduced mercury content.

BRIEF DESCRIPTION OF THE DRAWING

The drawing is a schematic flow diagram of a process for removing mercury from crude oils, natural gas condensates and other liquid hydrocarbons in which the three main embodiments of the invention can be employed. It should be noted that the drawing is a simplified process flow diagram and therefore does not show many types of equipment, such as heat exchangers, valves, separators, heaters, compressors, etc., not essential for understanding the invention by one skilled in the relevant art.

DETAILED DESCRIPTION OF THE INVENTION

The drawing depicts a process for treating mercury-contaminated crude oil in accordance with the process of the invention in order to remove the mercury and make the oil more suitable for refining. It will be understood that, although crude oil is described as the feedstock being treated to remove mercury, the process can be used to treat any hydrocarbons that are liquid at ambient conditions and contain undesirable amounts of mercury. Examples of such liquid hydrocarbons include, among others, naphthas, kerosene, gas oils, atmospheric residues, natural gas condensates, and liquefied natural gas. The process of the invention can be used to treat any liquid hydrocarbon feedstock containing more than 10 ppbw mercury and is effective for treating feeds containing more than 50,000 ppbw mercury. When the feedstock is a natural gas condensate, it typically contains between about 25 and about 3000 ppbw mercury, usually between about 50 and about 1000 ppbw. Typical crude oils fed to the process of the invention have mercury levels ranging from about 100 to about 25,000 ppbw mercury and quite frequently contain between about 200 and about 2500 ppbw mercury.

In the process shown in the drawing, produced crude oil contaminated with mercury, usually at a temperature between about 15 and 30° C. and a pressure from about 15 to about 50 psig., is directed through line 10 into heat exchanger 12 where it passes in indirect heat exchange with a purified crude oil or other mercury-depleted hydrocarbon liquid entering the heat exchanger through line 14. The preheated crude oil is then passed through line 16 into a second heat exchanger 18 to raise the temperature of the crude oil above its wax cloud point, i.e., the temperature above which no wax crystals form in the oil, usually by passing in indirect heat exchange with steam produced in a boiler not shown in the drawing. If the wax cloud point is below the ambient temperature, one or more of the heat exchangers may be eliminated from the process flow scheme.

Normally, the crude oil is contaminated with dissolved elemental mercury, mercury-containing colloidal particles and/or droplets, and solids on which mercury has been adsorbed. The latter solids are typically comprised of reservoir solids, such as sand and clays, and carbonate particulates that precipitate as the crude oil is produced. The mercury-contaminated solids and colloidal mercury particles are preferably removed prior to treating the crude to remove the dissolved mercury.

Referring again to the drawing, the crude oil, after being heated above its cloud point, is passed from heat exchanger 18 through line 20 to hydrocyclone 22 where solids and colloids containing mercury are removed from the crude through underflow line 24 and passed through valve 26 into waste solids accumulation tank 28. Normally, all solids having a particle size greater than about 10 microns, preferably greater than 5 microns, and most preferably above 3.0 microns, are removed in this step of the process. Although a hydrocyclone is shown in the drawing as the means for removing mercury-contaminated solids and particulate mercury, other liquid-solids separation techniques, such as filtration and centrifuging, may be employed. For example, in lieu of the hydrocyclone, a cartridge filter employing diatomite as a filter aid may be used. For some crude oils, such as those from the Austral Basin in Argentina that usually contain over 2000 ppbw mercury, it has been found that this solids removal step of the process can reduce total mercury concentration in the crude from as high as 22,000 ppbw to below 2000 ppbw.

Crude oil containing dissolved mercury but depleted in mercury-containing particulates is discharged from hydrocyclone 22 via line 28 and mixed with a mercury precipitant injected into line 28 through line 30. The resultant mixture is passed through static mixer 32 where the mercury precipitant is thoroughly mixed with the crude oil or other hydrocarbon liquids. The mercury precipitant is a sulfur-containing organic and/or inorganic compound that reacts with dissolved mercury in the crude oil to form a mercury-containing precipitate, which can then be removed from the liquids to form an oil of reduced mercury content.

In a preferred embodiment of the process of the invention, the mercury precipitant is an organic compound containing at least one sulfur atom that is reactive with mercury. Examples of such organic compounds include, but are not limited to, dithiocarbamates, either in the mono-meric or polymeric form, sulfurized olefins, mercaptans, thiophenes, thiophenols, mono and dithio organic acids, and mono and dithioesters. Normally, a sufficient amount of the organic, sulfur-containing compound is introduced into line 28 through line 30 so that the resultant mixture contains between about 1.0 and about 1000 ppmw, preferably between about 5.0 ppmw and about 100 ppmw, of the compound.

Although any liquid or solid dithiocarbamate can be used as the organic mercury precipitant, the preferred species have the following formula:

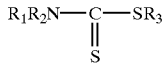

where $R_1$ and $R_2$ are the same or different and are independently selected from the group consisting of hydrogen atoms and unsubstituted or substituted hydrocarbyl radicals having from 1 to 20, preferably 1 to 4, carbon atoms, and $R_3$ is selected from the group consisting of hydrogen, and cations of the alkali or lkaline earth metals. The dithiocarbamates may be used either in a pure form or dissolved in an aqueous and/or organic carrier solvent. Preferred dithiocarbamates for use in the process of the invention are alkyl dithiocarbamates, such as ethyl dithiocarbamates and sodium dimethyl-dithiocarbamate. Treating agents containing dithiocarbamates dissolved in a carrier solvent that can be used successfully in the process of the invention are available from Betz-Dearborn as waste treatment additives Metclear MR 2404 and MR 2405.

The sulfurized olefins useful as the organic mercury precipitant include sulfurized isobutylenes having one of the following structural formulas:

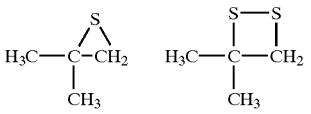

The sulfurized olefins may be used in pure form or dissolved in a carrier solvent. Treating agents containing a sulfurized isobutylene having one or more of the above structures are available from Ethyl Corporation as gear oil additives Hitec 312 and 350.

In another embodiment of the process of the invention, the chemical precipitant is an aqueous solution of a sulfur-containing inorganic compound chosen from the group of alkali metal sulfides, alkali metal polysulfides, alkaline earth metal sulfides, alkaline earth metal polysulfides, and alkali metal trithiocarbonates, such as sodium trithiocarbonate ($Na_2CS_3$) When employing this embodiment of the invention, it has been surprisingly found that only a very small amount of the aqueous solution, which normally contains between about 1.0 and 25 weight percent (preferably from 5.0 to 20 weight percent) of the sulfur-containing compound, is required in order to achieve a significant removal of the dissolved elemental mercury from the crude oil or other liquid hydrocarbons. Satisfactory mercury removal is obtained when the volume ratio of the aqueous solution to the oil in line 28 is less than 0.003 and even as low as 0.0002. Preferably, the volume ratio is between about 0.00075 and 0.002. The use of such small volumes of the aqueous solution has the advantage that there is little water available to emulsify in the oil, and this in turn makes the subsequent separation of the aqueous phase from the oil unnecessary. Preferred chemical precipitants for use in this embodiment of the invention are the alkali metal sulfides, preferably sodium and potassium sulfide.

In yet another embodiment of the process of the invention, the chemical precipitant is supported on particulate carrier solids, which are then mixed with the oil containing the dissolved mercury. The carrier solids are preferably diatomite and are normally comprised entirely of particles ranging in size from about 3 to about 60 microns, which particles have a median diameter between about 10 and 50 microns. The diatomite or other carrier solids support the mercury precipitant on a large surface area making it more easily available for reaction with the dissolved mercury and also serves as a filter aid when separating the resultant mercury-containing solids from the oil. The diatomite or other carrier solids used are typically free of metal cations that form water insoluble metal polysulfides having a Ksp of $10^{-6}$ or less. Preferably, the diatomite or other carrier solids are substantially free of copper, iron, nickel, zinc, and cadmium.

The mercury precipitant supported on the carrier solids may be an inorganic sulfur-containing compound chosen from the group of alkali metal sulfides, alkaline earth metal sulfides, alkali metal polysulfides, alkaline earth metal polysulfides and alkali metal trithiocarbonates, or an organic sulfur-containing compound having at least one sulfur atom that is reactive with mercury. The preferred inorganic sulfur-containing compounds are the alkali metal sulfides, such as potassium and sodium sulfide, and the preferred organic sulfur-containing compounds are dithiocarbamates and sulfurized olefins, such as sulfurized isobutylenes. The carrier solids contain a sufficient amount of the inorganic or organic sulfur-containing compound so that the concentration of sulfur on the solids is between about 1 and about 20 weight percent, calculated as S, based on the total weight of the solids. Usually, sufficient solids carrying the sulfur-containing compound are mixed with the oil or other liquid hydrocarbons so that the resultant mixture contains between about 10 and 1000 ppmw of the solids.

Referring again to the drawing, the mixture of oil and mercury precipitant exiting static mixer 32 is passed through line 34 into reaction tank 36 where the mixture is stirred for a time ranging from about 1.0 to about 60 minutes, preferably between about 2.0 and 30 minutes. Here the mercury precipitant reacts in the absence of a fixed bed with mercury dissolved in the oil to form a mercury-containing precipitate. This reaction is normally sufficient to remove all but a few hundred ppbw, usually between about 100 and 300 ppbw, of the dissolved mercury from the oil. The temperature in the reaction tank is normally maintained between about 25 and 75° C., while the pressure is kept below about 15 psig, usually in the range from about 3.0 psig to about 10 psig. When the mercury precipitant used is supported on carrier solids, some, if not the vast majority, of the precipitated mercury will associate with the carrier solids.

The effluent from reaction tank 36, which contains crude oil or other liquid hydrocarbons depleted in dissolved mercury, the mercury-containing precipitate formed in the reaction tank and, in some embodiments of the invention, the carrier solids used to support the mercury precipitant, is passed overhead through conduit 38 via pump 37 to separator 40 where particulate matter is removed from the liquid hydrocarbons. Although the separator can be any type of device capable of removing small particulates from liquids, it is normally a filter system, preferably a clarifying precoat pressure filter that uses cartridges precoated with diatomite to filter particulates from the oil. In the embodiment of the invention where diatomite is used as a carrier for the mercury precipitant, it is normally not necessary to precoat the filter cartridges with diatomite as the carrier solids will serve as the coating.

As the effluent from the reaction tank is forced through the coated cartridges of the filter system 40 by a pressure drop of between about 5 and 50 psig, the mercury-containing particulates formed in the reaction tank are deposited in the layers of diatomite as the crude oil or other liquid hydrocarbons pass through the cartridge filters and are removed from the filter system through conduit 42. This stream of oil is substantially depleted in mercury and normally contains between about 100 and 300 ppbw total mercury.

As the effluent from reaction tank 36 is passed through filter system 40 and undergoes depressurization, gases containing small amounts of mercury, normally from about 20 to about 100 milligrams per cubic meter, are formed. These gases are removed from the filter system through line 44, treated to remove these trace amounts of mercury, and vented to the atmosphere.

An increase in pressure drop across the filter system 40 to about 50 psig indicates that the cartridge filters are becoming substantially fouled with mercury-containing particulates and further filtration will be difficult. When this occurs, the cartridges are back flushed with a gas, such as methane, nitrogen, or carbon dioxide, introduced into the filter system through line 46 to force the filtered particulates and diatomite off the cartridges and out the filter system through line 48. This back flushing also forces a portion of the hyrocarbon liquids out of the filter system with the solids. The mixture of liquids and solids is passed via pump 50 through line 48 to hydrocyclone 52 where the solids are separated from the liquids. The separated liquids are returned to filter system 40 through conduit 54, while the solids and some residual liquids are passed via pump 56 through conduit 58 into waste accumulation tank 28. Here these mercury-containing solids are mixed with the mercury-containing solids removed from the liquid hydrocarbon feed in hydrocyclone 22, and the resultant mixture is periodically removed from the tank via conduit 60 for disposal, typically by injection into disposal wells.

The purified crude oil or other liquid hydrocarbons removed from filter system 40 through line 42 normally contain from about 100 to 300 ppbw mercury. If environmental regulations and other consideration are such that this amount of mercury is tolerable, the removed liquids can be passed through valve 62, adsorbent by-pass line 64, conduit 14, heat exchanger 12, and line 66 to storage tank 68 to await further processing or sale.

If, on the other hand, the mercury concentration in the liquids removed from the filter system 40 is considered too high, it can be further reduced by treating the liquids with a conventional mercury adsorbent. If this is the case, the liquids exiting the filter system 40 in line 42 are passed via valve 70 into adsorbent column 72 where the liquids are passed upward through a fixed bed of mercury adsorbent solids. As the liquids pass through the bed, residual mercury is adsorbed on the adsorbent solids, and a purified liquid of reduced mercury content is removed from the column through line 14. This liquid is then passed through heat exchanger 12 and line 66 to storage tank 68. Any conventional mercury adsorbent can be used in column 72. Examples of such adsorbents include P-5157 from Synetix Corporation, a subsidiary of ICI Performance Chemicals, MR-3 from UOP, and the mercury adsorbents described in U.S. Pat. No. 5,384,040. The liquids from the filter system are normally passed through the adsorbent column at ambient temperature and a pressure below about 15 psig, usually between about 5.0 psig and about 10 psig.

The purified hydrocarbon liquids exiting adsorbent column 72 in line 14 typically have a mercury concentration less than 10 percent, sometimes less than 5 percent, of the concentration of mercury fed to the process of the invention in line 10. Quite frequently the concentration of mercury in this liquid will be less than 10 ppbw, sometimes less than 5 ppbw. Thus, it should be clear that the process of the invention provides an efficient and effective route to removing mercury from hydrocarbon liquids.

The nature and objects of the invention are further illustrated by the following examples, which are provided for illustrative purposes only and not to limit the invention as defined by the claims. The examples show that (1) a substantial amount of mercury can be removed from crude oil or natural gas condensates by separating out particulate solids produced with these hydrocarbon liquids, and (2) the residual mercury remaining in the resultant filtrate can be further reduced by treating the filtrate with certain organic or inorganic sulfur-containing compounds.

EXAMPLE 1

Two relatively fresh samples (Samples 1 and 2) of a 50° API crude oil, which samples contained different concentrations of mercury were passed under nitrogen pressure through filter paper of various sizes or through a bed of diatomite (Celatom FW-12) having a median particle size of 24 microns. The diatomite was supported on an 18 micron stainless steel filter screen contained in a stainless steel filter housing. The oils exiting the filters and the bed of diatomite were analyzed for mercury. Similarly, three relatively fresh samples (Samples 3, 4 and 5) of 55° API natural gas condensate from offshore wells in the Gulf of Thailand were passed through filter paper of various sizes or a bed of diatomite, and the concentration of mercury in the filtrate was analyzed. The results of these tests are set forth below in Table 1. A mercury species analysis indicated that less than 10 weight percent of the mercury in each sample of oil and condensate was in the ionic form with the remainder being in the elemental form.

TABLE 1

| | Oil Samples | | Condensate Samples | | |
|---|---|---|---|---|---|
| Sample Treatment | No. 1 | No. 2 | No. 3 | No. 4 | No. 5 |
| Starting Hg concentration (ppbw) | 2200 | 1750 | 1294 | 642 | 588 |
| Hg concentration after 18 micron filtration (ppbw) | 1700 | — | — | — | |
| Hg concentration after 3.0 micron filtration (ppbw) | 800 | 410 | 1172 | 179 | |

TABLE 1-continued

| | Oil Samples | | Condensate Samples | | |
|---|---|---|---|---|---|
| Sample Treatment | No. 1 | No. 2 | No. 3 | No. 4 | No. 5 |
| Hg concentration after 1.2 micron filtration (ppbw) | 700 | — | 1100 | 132 | |
| Hg concentration after 0.7 micron filtration through diatomite (ppbw) | — | 310 | — | — | 367 |

The data in the table show that, in all cases, the smaller the filter medium, i.e., the more particles removed from the oil and condensate, the less mercury that remained in the filtrate. As can be seen, filtration through the 3 micron filter paper removed substantially more than 50 percent of the mercury in both samples of crude oil and in condensate Sample 4. The data for Samples 1, 2, 4 and 5 illustrate that mercury adsorbs on particulate matter in the oil, and removing the particulate matter removes the adsorbed mercury. It is postulated that the mercury concentration in the condensate of Sample 3 was reduced less than 10 percent because the condensate had a low concentration of particulate matter on which the mercury could adsorb. It is clear from the data in Table 1 that a substantial amount of mercury can be removed from the oil and condensate by removing particulate matter.

EXAMPLE 2

A relatively fresh sample of a 500° API crude oil was passed under nitrogen pressure through 3.0 micron filter paper, and 100 cc of the resultant filtrate was mixed in a glass container under a nitrogen atmosphere with 0.02 cc of a 5 weight percent unbuffered (pH greater than 10) aqueous solution of sodium sulfide ($Na_2S$). The volume ratio of sodium sulfide solution to filtered crude oil was 0.0002. The treated oil from the glass container was then passed through another 3.0 micron filter, and the filtrate was analyzed for mercury. This procedure was repeated using 0.2 cc of a 0.5 weight percent buffered aqueous solution of sodium sulfide having a pH of 8.5. The volume ratio of sodium sulfide solution to filtered crude oil was 0.002. In each case the treat rate of sodium sulfide was 10 ppmw. The results of these tests are set forth below in Table 2.

TABLE 2

| Sample Treatment | Mercury Concentration (ppbw) | Percent Mercury Removal |
|---|---|---|
| Starting oil | 2190 | — |
| Oil subjected to 3.0 micron filtration | 573 | 74 |
| Filtrate treated with 10 ppmw $Na_2S$ in unbuffered solution and subjected to 3.0 micron filtration | 470 | 79 |
| Filtrate treated with 10 ppmw $Na_2S$ in buffered solution and subjected to a 3.0 micron filtration | 340 | 84 |

Like the data in Table 1, the data in Table 2 show that an initial particulate removal step substantially reduces (74%) the mercury content of the crude oil. The data in Table 2 also illustrate that further removal of dissolved mercury from the filtrate can be obtained using very small volumes of an aqueous sodium sulfide solution, preferably a buffered solution.

EXAMPLE 3

A sample of the 500° API crude oil used in Example 1 was allowed to age for about 4 months. A mercury species analysis showed that approximately 50 percent of the mercury in the oil was in the ionic form. The sample was heated to 50° C. and passed under nitrogen pressure through 3.0 micron filter paper. The filtrate was analyzed for mercury three times and the results were averaged. The concentration of mercury in the crude oil was reduced by the filtration from 2200 ppbw to 1312 ppbw. About 200 cc of the filtered oil was mixed at 50° C. in a nitrogen-flushed glass container with a much smaller amount (about 0.1 cc) of two different treating agents that comprised an organic compound containing a sulfur atom that is reactive with mercury. The resultant mixture was stirred for 10 minutes in the glass container and then passed through a 3 mm thick bed of diatomite (Celatom FW-12) to filter out particulates having diameters of 0.7 microns and above. The diatomite was supported on an 18 micron stainless steel filter screen contained in a stainless steel filter housing. The resultant filtrate was analyzed for residual mercury. The results of these tests are reported below in Table 3.

TABLE 3

| Run No. | Treating Agent | Concentration of Treating Agent (ppmw) | Mercury[1] Concentration After Second Filtration (ppbw) |
|---|---|---|---|
| 1 | Betz-Dearborn[2] MR 2404 | 500 | 155 |
| 2 | Betz-Dearborn[3] MR 2405 | 500 | 155 |

[1]Concentration of mercury in oil prior to treatment was 1312 ppbw.
[2]Contains monomeric sodium dimethyl-dithiocarbamate dissolved in a solvent.
[3]Contains polymeric dithiocarbamate dissolved in a solvent.

As can be seen in Table 3, treatment of the oil with 500 ppmw of chemicals containing monomeric sodium dimethyl-dithiocarbamate and polymeric dithiocarbamate was effective in reducing the mercury content from 1312 ppbw to 155 ppbw. The data in Table 3 also show that these sulfur-containing organic compounds are effective in reducing mercury concentrations when a substantial amount of the mercury (over 50 weight percent) is in the ionic form.

EXAMPLE 4

A fresh sample of 55° API natural gas condensate containing 588 ppbw mercury, all in the elemental form, was passed at ambient temperature through a 3 mm thick bed of diatomite supported on an 18 micron stainless steel filter screen contained in a stainless steel filter housing. The diatomite (Celatom FW-12) was sized to filter out particles having diameters of 0.7 microns or larger. The filtered oil was analyzed and found to contain 367 ppbw mercury. The filtered oil was then mixed at ambient temperature in a nitrogen-flushed glass container with very small amounts of the same treating agents used in Example 3. The resultant mixture was stirred for 30 minutes in the glass container and then passed through a fresh 3 mm thick bed of diatomite (Celatom FW-12) to again filter out particulates having diameters of 0.7 microns and above. The diatomite was supported on an 18 micron stainless steel filter screen contained in a stainless steel filter housing. The resultant filtrate was analyzed for residual mercury. The filtrate from the second filtration was then passed into a 1 inch ID glass column packed with ⅛ inch diameter beads of a commercially available mercury adsorbent, P-5157 adsorbent from Synetix Corporation (a subsidiary of ICI Performance Chemicals). The filtrate was kept in contact with the adsorbent for 30 minutes at ambient temperature. The condensate was then drained from the column and analyzed for mercury. The results of these tests are reported below in Table 4.

TABLE 4

| Run No. | Treating Agent | Concentration of Treating Agent (ppmw) | Mercury[1] Concentration After Second Filtration (ppbw) | Mercury Concentration After Adsorbent (ppbw) |
|---|---|---|---|---|
| 1 | Betz-Dearborn[2] MR 2404 | 100 | 118 | 7 |
| 2 | Betz-Dearborn[3] MR 2405 | 100 | 220 | 4 |
| 3 | Betz-Dearborn[3] MR 2405 | 10 | 104 | 6 |

[1]Concentration of mercury in oil prior to treatment was 367 ppbw.
[2]Contains monomeric sodium dimethyl-dithiocarbamate dissolved in a solvent.
[3]Contains polymeric dithiocarbamate dissolved in a solvent.

The data in Table 4 show that use of the organic sulfur-containing compounds in the treating agents reduced the mercury concentration of the condensate from 367 ppbw to 220 ppbw or below. Surprisingly, the use of only 10 ppmw of the treating agent containing polymeric dithiocarbamate resulted in reducing the mercury content of the condensate to 104 ppbw as compared to 220 ppbw obtained with 100 ppmw of the same treating agent. Thus, it appears that using smaller amounts of the organic sulfur-containing compound may result in better mercury removal.

It is also seen from Table 4 that treating the condensate from the second filtration with a conventional mercury adsorbent can further reduce the residual mercury concentration to below 10 ppbw. Thus, this added process step can be used if concentrations of mercury below about 100 ppbw are required in the condensate or other liquid hydrocarbons.

EXAMPLE 5

For comparison purposes, a sample of the once-filtered condensate from Example 4, which contained 367 ppbw of mercury, was placed into contact as described in Example 4 with the same commercial mercury adsorbent used in Example 4 but without first being subjected to treatment with an organic sulfur-containing compound. The mercury content of the resultant liquid was found to be 19 ppbw, a value more than three times that obtained from the average (5.7 ppbw) of Runs 1–3 in Example 4. Since the commercial cost of the mercury adsorbent is 3.5 times higher than that of the treating agents used in Examples 3 and 4, it remains more economical to use the chemical treating agents either in lieu of using the adsorbent or, if very small concentrations of mercury are desired, prior to using the adsorbent. The latter process configuration would significantly reduce the amounts of the adsorbent that would otherwise (i.e., if no treating agent is used) be required to achieve similar reductions in mercury concentrations.

Although this invention has been described by reference to several embodiments of the invention, it is evident that many alterations, modifications and variations will be apparent to those skilled in the art in light of the foregoing description. Accordingly, it is intended to embrace within the invention all such alternatives, modifications and variations that fall within the spirit and scope of the appended claims.

We claim:

1. A method for removing mercury from a liquid hydrocarbon feed comprising:

(a) mixing said liquid hydrocarbon feed with particulate solids comprising a sulfur-containing compound supported on diatomite, said sulfur-containing compound selected from the group consisting of alkali metal sulfides, alkaline earth metal sulfides, alkali metal polysulfides, alkaline earth metal polysulfides, alkali metal trithiocarbonates, and an organic compound containing at least one sulfur atom that is reactive with mercury, wherein said diatomite is substantially free of metal cations that form water insoluble metal polysulfides having a Ksp of $10_{-6}$ or less; and b) separating said particulate solids from the effluent of step (a) to produce liquid hydrocarbons having a reduced mercury concentration as compared to said liquid hydrocarbon feed.

2. A method for removing mercury from a liquid hydrocarbon feed comprising:

(a) mixing said liquid hydrocarbon feed with an organic compound containing at least one sulfur atom that is reactive with mercury, wherein said organic compound is not supported on carrier solids and is selected from the group consisting of sulfurized isobutylenes, dithiocarbamates, alkyl dithiocarbamates, polymeric dithiocarbamates, sulfurized olefins, thiophenes, mono and dithio organic acids, and mono and dithioesters; and (b) separating mercury-containing particulates formed in step (a) by the reaction of said organic compound with mercury from the effluent of step (a) to produce liquid hydrocarbons having a reduced mercury concentration as compared to said liquid hydrocarbon feed.

3. A method for removing mercury from a liquid hydrocarbon feed comprising:

(a) mixing said liquid hydrocarbon feed with a sufficient amount of an aqueous solution of a sulfur-containing compound selected from the group consisting of alkali metal sulfides, alkaline earth metal sulfides, alkali metal polysulfides, alkaline earth metal polyulfides, and alkali metal trithiocarbonates such that the resultant mixture contains a volume ratio of said aqueous solution to said liquid hydrocarbon feed less than 0.003; and (b) separating mercury-containing particulates formed in step (a) from the effluent of step (a) to produce liquid hydrocarbons having a reduced mercury concentration as compared to said liquid hydrocarbon feed.

4. The method defined by any one of claims 1, 2, or 3 further comprising the step of removing mercury-containing particulate solids from said liquid hydrocarbon feed prior to step (a).

5. The method defined by claim 4 wherein said mercury-containing -solids are removed by a hydrocyclone.

6. The method defined by any one of claims 1, 2, or 3 wherein said liquid hydrocarbon feed is selected from the group consisting of natural gas condensates and crude oils.

7. The method defined by claim 1 wherein said diatomite is substantially free of copper.

8. The method defined by claim 1 wherein said diatomite is substantially free of iron, nickel, copper, zinc, and cadmium.

9. The method defined by claim 1 wherein said sulfur-containing compound comprises an organic compound having at least one sulfur atom that is reactive with mercury.

10. The method defined by claim 2 or 9 wherein said organic compound is selected from the group consisting of sulfurized isobutylenes and dithiocarbamates.

11. The method defined by claim 2 or 9 wherein said organic compound comprises an alkyl dithiocarbamate.

12. The method defined by claim 1 or 3 wherein said sulfur-containing compound is selected from the group consisting of alkali metal sulfides and alkaline earth metal sulfides.

13. The method defined by claim 1 or 3 wherein said sulfur-containing compound comprises sodium sulfide or potassium sulfide.

14. The method defined by claim 1 wherein sufficient particulate solids are mixed with said liquid hydrocarbon feed such that the resultant mixture contains between about 10 and about 1000 ppmw of said solids.

15. The method defined by claim 2 wherein a sufficient amount of said organic compound is mixed with said liquid hydrocarbon feed such that the resultant mixture contains between about 1.0 and about 1000 ppmw of said organic compound.

16. The method defined by claim 3 wherein the volume ratio of said aqueous solution to said liquid hydrocarbon feed is about 0.001 or less.

17. The method defined by claim 2 or 9 wherein said organic compound comprises a polymeric dithiocarbamate.

18. The method defined by any one of claims 1, 2, or 3 wherein step (b) is carried out in a clarifying precoat pressure filter.

19. The method defined by any one of claims 1, 2, or 3 wherein the concentration of mercury in said liquid hydrocarbons having a reduced concentration of mercury is less than about 10 percent of the concentration of said mercury in said liquid hydrocarbon feed.

20. The method defined by claim 1 wherein said particulate solids contain a sufficient amount of said sulfur-containing compound so that the concentration of sulfur in said solids is between about 1 and about 20 weight percent, calculated as S, based on the total weight of said solids.

21. The method defined by claim 1 wherein substantially all of said particulate solids range in size between about 3 and about 60 microns.

22. The method defined by any one of claims 1, 2, or 3 wherein the concentration of mercury in said liquid hydrocarbon feed ranges from about 10 to about 50,000 ppbw.

23. The method defined by claim 3 wherein said aqueous solution contains between about 1 and about 25 weight percent of said sulfur-containing compound.

24. The method defined by claim 2 wherein said organic compound is selected from the group consisting of sulfurized olefins, thiophenes, mono and dithio organic acids, and mono and dithioesters.

25. The method defined by claim 2 wherein said organic compound is a liquid.

26. A method for removing mercury from a liquid hydrocarbon feed comprising:

(a) removing mercury-containing particulates from said liquid hydrocarbon feed;

(b) mixing the effluent from step (a) with a sulfur-containing compound having the formula

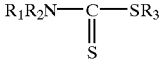

where $R_1$ and $R_2$ are the same or different and are independently selected from the group consisting of hydrogen atoms and unsubstituted or substituted hydrocarbyl radicals having from 1 to 20 carbon atoms, and $R_3$ is selected from the group consisting of hydrogen, alkali metal cations and alkaline earth metal cations, wherein said sulfur-containing compound is not supported on carrier solids; and (c) separating mercury-containing particulates formed in step (b) by the reaction of said sulfur-containing compound with mercury from the effluent of step (b) to produce liquid hydrocarbons having a reduced mercury concentration as compared to said liquid hydrocarbon feed.

27. The method defined by claim 26 wherein $R_1$ and $R_2$ are alkyl groups having from 1 to 4 carbon atoms and $R_3$ is an alkali metal cation.

28. The method defined by claim 27 wherein said sulfur-containing compound is sodium dimethyl-dithiocarbamate.

29. The method defined by claim 26 further comprising the step (d) of contacting the effluent from step (c) with a mercury sorbent.

30. The method defined by claim 29 wherein the concentration of mercury in said liquid hydrocarbon feed is greater than 100 ppbw and the concentration of mercury in the effluent from step (d) is less than about 10 ppbw.

31. The method defined by claim 2 or 26 wherein said liquid hydrocarbon feed is a natural gas condensate having a mercury concentration between about 1,000 ppbw and about 3,000 ppbw.

32. The method defined by claim 2 or 26 wherein said liquid hydrocarbon feed is a crude oil having a mercury concentration between about 2,500 ppbw and about 25,000 ppbw.

33. A method for removing mercury from a liquid hydrocarbon feed comprising:

(a) mixing said liquid hydrocarbon feed with an aqueous solution of an alkali metal trithiocarbonate;

(b) separating mercury-containing particulates formed in step (a) from the effluent of step (a) to produce liquid hydrocarbons having a reduced mercury concentration as compared to said liquid hydrocarbon feed.

34. A method for removing mercury from a liquid hydrocarbon feed comprising:

(a) mixing said liquid hydrocarbon feed with an aqueous solution of a sulfur-containing compound selected from the group consisting of alkali metal sulfides, alkaline earth metal sulfides, alkali metal polysulfides, and alkaline earth metal polysulfides; and (b) without separating the aqueous solution from the hydrocarbon feed, removing mercury-containing particulates formed in step (a) from the effluent of step (a) to produce liquid hydrocarbons having a reduced mercury concentration as compared to said liquid hydrocarbon feed.

* * * * *

UNITED STATES PATENT AND TRADEMARK OFFICE

CERTIFICATE OF CORRECTION

PATENT NO. : 6,537,443 B1
DATED : March 23, 2003
INVENTOR(S) : Theodore C. Frankiewicz et al.

It is certified that error appears in the above-identified patent and that said Letters Patent is hereby corrected as shown below:

Column 11,
Line 13, cancel "$10\text{-}_6$" and insert in place thereof -- $10^{-6}$ --;
Line 42, after "alkaline earth metal" cancel "polyulfides" and insert in place thereof -- polysulfides --.

Signed and Sealed this

Seventh Day of October, 2003

JAMES E. ROGAN
*Director of the United States Patent and Trademark Office*